United States Patent [19]

Delair et al.

[11] 4,217,517

[45] Aug. 12, 1980

[54] SMALL DIVERGENCE X-RAY TUBE

[75] Inventors: Jacques Delair; Jacques Le Guen, both of Paris, France

[73] Assignee: Compagnie Generale de Radiologie, Paris, France

[21] Appl. No.: 4,558

[22] Filed: Jan. 18, 1979

[30] Foreign Application Priority Data

Jan. 24, 1978 [FR] France ..... 78 01878

[51] Int. Cl.[2] ..... H01J 35/06; H01J 35/10; H01J 35/14

[52] U.S. Cl. ..... 313/56; 313/57; 313/60

[58] Field of Search ..... 313/60, 57, 55, 56, 313/59

[56] References Cited

U.S. PATENT DOCUMENTS

| | | | |
|---|---|---|---|
| 1,610,863 | 12/1926 | Kucher | 313/57 X |
| 2,677,069 | 4/1954 | Bachman | 313/55 |
| 3,018,398 | 1/1962 | Atlee | 313/59 |
| 3,435,211 | 3/1969 | Softky | 313/55 X |
| 4,057,745 | 11/1977 | Albert | 313/55 |

*Primary Examiner*—Palmer C. Demeo

*Attorney, Agent, or Firm*—Roland Plottel

[57] ABSTRACT

An x-ray tube providing a flat, fan-shaped uniform x-ray beam.

The tube includes inside a vacuum glass envelope, a cathode or cathodes, a fixed or cylindrical rotating anode, and an anti-divergence diaphragm. The anti-divergence diaphragm has an opening, through which passes the beam. The walls of the opening have the shape of a sector of the fan-shaped beam in one plane (z–z'), and are flat in a perpendicular plane. A plurality of x-ray absorbing blades are positioned in the opening parallel to the fan-shaped side dividing the opening and the beam passing therethrough, thereby minimizing overall divergence of the beam. A plurality of cathodes may be used in the rotating anode tube, each separately focusable to provide beams of different intensity, and alternately operable.

10 Claims, 4 Drawing Figures

SMALL DIVERGENCE X-RAY TUBE

This invention relates generally to x-ray tubes and particularly to tubes that reduce divergence of the tube's ray that find use in tomographic apparatus. These tubes produce with collimating means, such as a slit diaphragm, a beam of x-rays, flat, of constant thickness, and of a given angle whose emanating energy fans out with a substantially uniform density in all directions on a plane over this angle.

Different types of tubes have been developed to create such a beam. They comprise a cathode emitting a beam of electrons having a rectangular cross-section and a fixed or turning anode bombarded by the electron beam, all this inside an airtight glass tube.

The bombarded section of the anode, the focus or focal surface, emits x-rays which are flat and fan-shaped with the aid of a collimation device, for example a slitted diaphragm mounted outside the tube.

The uniform distribution of radiating energy is linked to the shape of the anode. For example, in an x-ray tube with a rotating cylindrical-shaped anode, a flat, fanned beam of x-rays is obtained by bombarding the cylindrical surface of the anode with a rectangular cross-sectioned electron beam.

The cathode is placed clear of the area in front of the rectangular focus on an x-ray generating surface of the cylindrical anode. The axis of the emanating x-ray beam is normal to this cylindrical surface.

Moreover, an external diaphragm is used as collimation, and a rectangular slit is positioned to select the beams emitted from the focus in such a way as to obtain a resulting beam that is flat and fan-shaped. This is described in French Patent application no. 77 02456, filed by Compagnie Generale de Radiologie on Jan. 28, 1977 and published with the U.S. Pat. No. 2,379,158 (U.S. patent application Ser. No. 871 994, filed on Jan. 24, 1978, and assigned to the same assignee as this application).

The x-ray tube with the cylindrical revolving anode can also be used with an "anti extra focal" device having two layers of different materials, and mounted close and parallel to the cylindrical surface of the anode. The external face of one of these layers absorbs and stops secondary electrons which exit from the impact surface, and thereby prevents a new acceleration that would then provoke additional beams from other parts of the anode.

The second layer is closer to the cylindrical surface of the anode and absorbs the additional x-ray beams emitted from the anode in other points besides the area of impact.

In the case of an x-ray tube with a fixed anode, the emitting surface of x-rays is placed in a well in the anode. This well, which is made of copper or other similar material, serves as a target for an electron beam from the cathode in such a way that the resulting x-ray beam is emitted through a second well connected to the first one at a 90° angle. In this type of tube, stray radiation is limited by the fact that the anode's generating surface is recessed in a very thick copper well. In this case, external slitted diaphragms may also be used so as to obtain a flat, fanned x-ray beam.

A radiology device, tomographic apparatus, includes one of these x-ray tubes with an x-ray detector thereby providing a tool both for measuring the absorption rate of a body placed between this tube and the detectors as well as for observing an inside section of the body.

Ideally, only a specific zone of the body would be radiated and the detectors would absorb the totality of the reduced radiation through the use of a fan-shaped flat x-ray beam of constant thickness.

In current technology, a beam of constant thickness is an ideal beam that cannot yet be made but that must be approximated as closely as possible. The slitted diaphragms, which are mounted close to the object being examined, do not sufficiently eliminate beam divergence and only allow fanned beams whose directions are not parallel.

The zones on either side of the theoretical parallel directions cause a useless irradiation of the object in places which cannot be observed, as well as a pernicious increase in emitted radiation.

For a single x-ray emission, the zone to be observed is exposed to radiation inferior to the radiation that would be used in the theoretical case of a flat fan-shaped beam.

To compensate for this and to achieve an accurate observation, the degree of radiation emitted by the tube must be increased. Thus, a larger dose of x-rays than is necessary is applied to the object being observed. Because tomodensitometers are used to observe the human body, this increase is extremely harmful and requires considerable protection against undesired radiation.

The subject of this patent is a device to reduce the divergence of the operational fanned beam of an X-Ray tube.

According to the invention, a slitted diaphragm with parallel openings is placed inside the glass vacuum tube close to the anode's focus. The tube can use either a fixed anode or a cylindrical turning anode.

This diaphragm includes a support in the shape of a sector of a ring and has its slotted opening in front of the x-ray emitting surface of the anode, in such a way that the plane of the fan-shaped beam is perpendicular to this anode surface. This opening has a shape that is the same as part of the desired fan-shaped beam; in the plane of the fan shape it has the shape of a sector or segment of a ring, and in the plane perpendicular to the fan-plane it has a rectangular section of a height the same as the desired thickness of the x-ray beam.

The blades which are opaque to x-rays, e.g., tantalum, are positioned in the opening in parallel to each other and parallel also to the plane of the ring-shaped sector. These blades allow the apparent focal point of the anode to be split up in many small focuses at the level of the diaphragm opening. In operating it is as if these small apparent focuses created fan-shaped x-ray beams with very small divergences.

The emitted x-ray beam is cut into a number of very thin fan-shaped x-ray beams equal to the number of blades plus one.

This occurs at the exit of the diaphragm and is caused by the shadow that the opaque blades cast on the x-rays.

However, the divergence of the beams, small but nevertheless present, linked with the considerable distance between the diaphragm and the object to be radiated, will dispel these shadow effects because of its position inside the tube. Because of the considerable distance between the diaphragm and the body to be radiated, the body is subjected to a reconstituted flat, fan-shaped beam whose divergence is the same as the divergence of a beam emanating from between the blades, that is to say, very small.

The opaque blades are covered by thin metallic layers to avoid adverse effects of their fields on the tubes' glass and the extra-focal residual radiation phenomena in the case of a cylindrical turning anode. These thin metallic layers, e.g. nickel, also serve as filtering agents because they absorb weak x-rays. They thus filter residual extra-focal radiation, a radiation that is very weak compared to the operational beam.

These and other features of the invention will be shown in the following detailed description and accompanying drawings of non-limiting examples of the invention.

FIGS. 1 and 2 show longitudinal axial, and transversal, views of a cylindrical turning anode x-ray tube of the invention.

Figure 1:
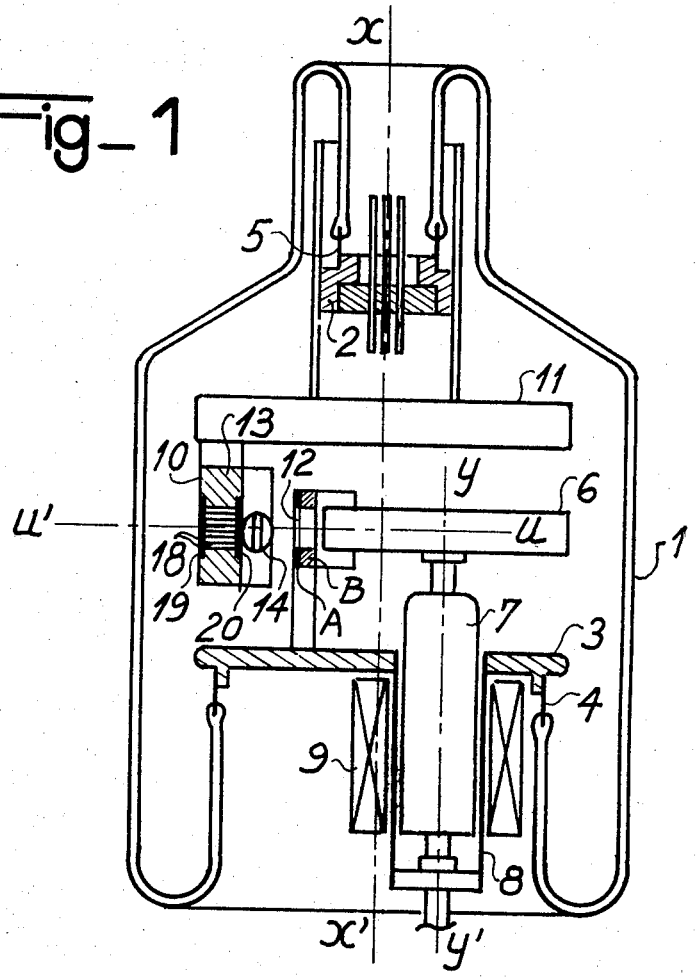
FIG. 1 is a plane partially sectional view through the longitudinal axis of a cylindrical turning anode x-ray tube using the invention.

The tube has a cylindrical glass envelope whose revolution axis is xx' and whose ends are joined in an "ultra vacuum proof" or hermetically tight seals to a cathode support 2 and an anode support 3. These seals are achieved by any convenient or conventional means, for example by rings 4 and 5 made of a metal alloy whose thermal coefficient of expansion is close to that of the glass.

A revolving anode 6, in the shape of a flat cylinder, and whose surface is of an x-ray emitting material (e.g. tungsten), is joined to a rotor 7 whose rotation axis yy' is off center with the axis xx' of the tube. A vacuum-proof housing and seal of the rotor 7 and the metallic disc 3 is completed by a thin metallic rotor neck 8. An example of such a structure is described in French Patent application no. 77 23444, filed by Compagnie Generale de Radiologie on July 29, 1977 (U.S. Pat. application no 928 216, filed on July 28, 1978, and assigned to the same assignee as this application). Alternatively, any convenient or conventional drive arrangement may be used to rotate the anode.

The rotor 7 is rotated by a turning field created by a stator 9. Stator 9 has the same potential as the anode 6 which, for example, can be either ground or a high positive potential as described in the previously cited application.

An "anti-extra focal" device 12 in the shape of a sector of a ring, co-axial with the rotation axis yy' of the anode 6, is mounted very close to the cylindrical surface of the anode. It is mechanically mounted on the metallic disc 3 and has the same potential as the anode. It is made of two layers A and B, and has a hole in its center to let electron beams 15 and 15' pass to the anode target, and x-ray beam exit from the target. Layer A is made of light material such as graphite, or titanium, or any other material that absorbs secondary electrons which, reaccelerated, would bombard other parts of the anode besides the point of impact of the electron beams 15 or 15' and would create extra focal x-ray beams. The B layer is made of a material with a high atomic weight such as tungsten. It is bonded to the A layer, and absorbs extra focal radiation emitted by other parts of the anode outside the point of impact of the electron beam.

The size of the anti-extra focal device 12 is such that it covers the interval projected on itself by the tangents aa' and bb' to the anode 6. The only possible x-ray source is limited to a vertical dimension at its opening.

A field distributor 11, parallel to the circular surfaces of the anode, is mounted on the cathode support 2; and perpendicular thereto on the side facing the anode, there is mounted a further support 10 carrying a part 13. Part 13 is in the shape of a sector of a ring whose center or axis is the same as the axis xx' of the glass envelope 1.

Part 13 is made of a metal having a very high atomic weight so as to absorb x-rays and is the mount for both a slitted diaphragm, and also for two cathode beam emitters 16 and 16'.

Figure 2:
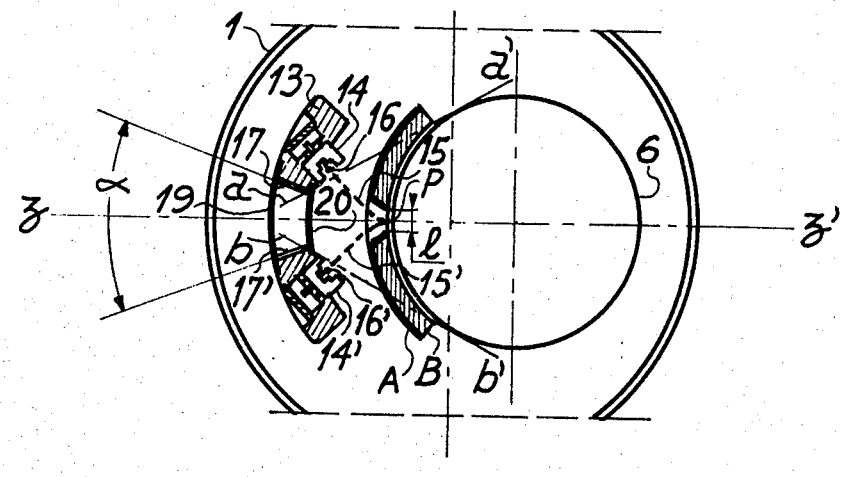
FIG. 2 is a transversal sectional view of the tube in FIG. 1.

The two cathode emitters 16 and 16' have two focusing devices 14 and 14' positioned in such a way that the electron beams 15 and 15' have an elongated rectangular cross section in the plane perpendicular to that in FIG. 2, and reach the cylindrical surface of the anode 6 at the point (or line) P which represents the focal point. Thus, the usable x-ray beam emerges from the anode's cylindrical surface is generated at P.

The two cathode emitters 16 and 16' are insulated electrically from the focusing pieces 14 and 14' so as to permit the focusing pieces to be biased negatively relative to the emitters.

A cathode grid (not shown) allows the concentration of the electron beam, producing the focus beam and/or blocking the beam according to a control voltage applied to the grid. The reduction of the electron beams, and its focus thus can produce the smallest possible rectangular cross-section area on the anode target.

The two emitters thus create two electron beams allowing a large gamut of foci of various dimensions stemming from the initial dimension, without applying any polarization to the concentration pieces. The beam's dimensions can be either the same or different.

The two emitters are not used simultaneously.

The cathode emitters 16 and 16' with their concentration parts 14 and 14' are mounted symmetrically on the ring-shaped segment part 13 so as to balance the field lines in the cylindrical cathode surface space of the anode, and also to clear the area in front of the rectangular focus produced by one of the two electron beams, coinciding with an x-ray generating surface on the cylindrical surface of the anode, and in such a way that the axis of the fan-shaped x-ray beam thereby produced is perpendicular to the cylindrical surface at the focused point P.

Part 13 has an opening in its center facing the anode's focus to allow the passage of the emerging x-ray beam along axis zz' and having a fan angle $\alpha$ and height that is substantially the same as the length of the focus, i.e., substantially the same as the length of the impacting electron beam on the anode.

This opening also has a center line on the axis zz' (axis of symmetry), and its opening has a shape converging at angle $\alpha$ whose apex is the point P. Several grooves 17 and 17' are cut into the sides of the opening, and in which are mounted several parallel blades 18. These blades are parallel to the plane of the fan of the x-ray beam, and perpendicular to the anode's x-ray generating line P.

These blades are of tantalum or any other material that is opaque to x-rays in order to prevent too great a divergence of the operational x-ray beam.

The divergence will be a function of the exit angle of the blades and of their length in the direction of propagation of the operational beam so that the closer they are, the greater the division into apparent foci and the more the divergence is limited.

However, one has to compensate by increasing the tube's power, for the fraction of the x-rays emitted from the focus that is stopped by these blades due to their thicknesses, lengths, or orientation.

Moreover, these x-ray opaque blades are covered by a thin layer of nickel or of any other appropriate metal 19 and 20, so as to avoid beam effects harmful to the glass casing 1 and to the anti extra focal device 12.

The location of the concentration pieces 14 and 14' on part 13, in the space created by the two planes containing the two circular sides of the anode, is not the only possible one.

They can be placed, for example, symmetrically to the bladed opening but on a plane perpendicular to that used in FIGS. 1 and 2. This can be done without impairing the effectiveness of the anti-divergent part of the invention.

Figure 3:
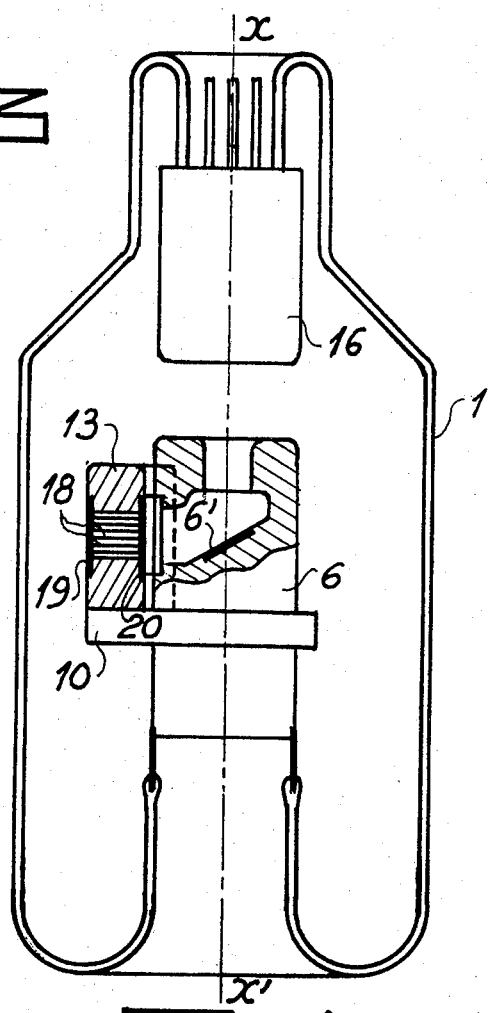
FIG. 3 is a plane partially sectional view through the longitudinal axis of a fixed anode x-ray tube incorporating the invention.
Figure 4:
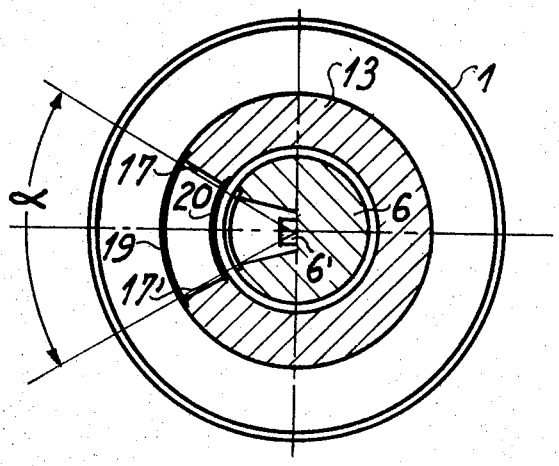
FIG. 4 is a transverse sectional view of a fixed anode x-ray tube showing a modification of the embodiment of FIG. 3.

FIGS. 3 and 4 represent two embodiments of x-ray tubes with a fixed anode having the anti-divergence device of the invention.

On these drawings the same parts as in FIGS. 1 and 2 have the same legends.

FIG. 3 is a plane, partially in section, axial view of the tube; it has the cylindrical glass casing 1 whose revolution axis is xx' and whose ends are joined, in the same manner as the rotating anode tube previously described, to a cathode 16 on one end and to an anode 6 on the other end.

The anode 6 has two wells or apertures, one following the direction of the xx' axis and the other perpendicular to it. The intersection of these two wells is at an inclined surface 6' which is x-ray emissive, and which is bombarded with a rectangular cross-sectioned electron beam emitted from the cathode 16.

The support 10 is here connected to the anode, and has the same charge as the anode. Part 13 mounted on support 10, is in the shape of a ring segment centered on the axis xx' which, by itself, is the diaphragm according to the invention.

An opening in part 13 lets pass therethrough the x-ray beam, coming from the focus located on surface 6' of the anode.

According to the invention, as in the case of the cylindrical turning anode, and for the same reasons, the opening is positioned close to the anode's focus and has opaque blades 18 mounted in grooves 17 and 17' in the walls of the opening.

These blades are parallel to each other, and are also parallel to the plane of the fanning out of the x-ray beam. Their thin outer edges are covered by thin strips of nickel or any other appropriate metal 19 and 20, so as to avoid field effects harmful to the glass 1 and to absorb any low extra focal radiation which is already very limited in this type of tube.

FIG. 4 is a transversal view of a tube similar to the one shown in FIG. 3 but with a modification in part 13. This part still has the opening with the opaque blades, but it totally surrounds the anode 6. This new shape allows a better distribution of the field inside the glass 1 and does not interfere with the proper functioning of the anti-divergence device.

The anti-divergence device of the invention also has the advantage of being inside the tube's glass casing, regardless of whether the tube is a fixed anode type of tube or a cylindrical turning type of tube. Its position and the arrangement of the opaque blades is adjusted once and for all so as to have the best possible flat fanned beam of constant thickness. The positioning of the diaphragm is thus unchangeable contrary to external diaphragms which constantly need new adjustments.

X-ray tubes, with fixed or cylindrical turning anodes, of the invention are used in axial, transversal type tomographic devices consisting of a pad having many radiation detectors, all of which are simultaneously irradiated by a fanned beam with a large opening. By placing the target between the tube and the detector pad, the small divergence of these tubes allows the target to be radiated, and only in the desired places so that the detectors receive almost all of the attenuated direct radiation.

This device improves detection and decreases harmful effects of the radiating zones due to divergence from the operational, fanned x-ray beam.

We claim:

1. An x-ray tube comprising an evacuated glass casing having therein:

a cathode which emits an electron beam;

an anode whose surface is bombarded by the said electron beam and emits an x-ray beam;

a curved divergence reduction diaphragm having a fan-shaped opening equipped with parallel, x-ray opaque blades, located close to the anode in front of the x-ray emitting surface so that the opaque blades cut said x-ray beam into fan-shaped x-ray beams with a small divergence, and at a distance from the tube, before an object normally receives the x-rays, the beams regroup to join in a single flat, fan-shaped x-ray of small divergence, said distance being a function of the length of the blades in the direction of the propagation of the x-rays, their spacing, and the divergence of the beams.

2. An x-ray tube according to claim 1, wherein said parallel, opaque blades inside the opening in the diaphragm are parallel to the flat plane of the fanned beam.

3. An x-ray tube according to claim 1, wherein the opaque blades placed inside the diaphragm's opening are covered by thin layer of a material which absorbs x-rays of weak energy relative to that of the operational beam so as to avoid field effects and radiation harmful to the tube and to the quality of the flat, fanned x-ray.

4. An x-ray tube according to claim 1, wherein said anode is a cylindrical rotating anode; a support for said anode; an anti extra focal device is mounted on said anode support; said diaphragm having the shape of a segment of a ring, co-axial with the axis of revolution of said glass casing, and parallel to the cylindrical surface of the anode, said cathode includes two cathode emitters and focusing devices mounted on said diaphragm and focusable by a control-polarization potential, said two cathodes being positioned symmetrically in relation to the opening so as to clear the space of impact of the electron beam on the anode, and so that the axis of the emanating x-ray beam is normal to the anode surface, and also the axis of the opening.

5. An x-ray tube according to claim 4 wherein said two cathode emitters are mounted symmetrically to the opening and are located in an area determined by two circular surfaces parallel to the cylindrical turning anode.

6. An x-ray tube according to claim 4 wherein said two cathode emitters include concentration devices that can be negatively polarized, said emitters adapted to never bombard the anode simultaneously, and they create two electron beams of adjustable size, adjustment being made by polarizing the concentration pieces thus permitting one to have a selection of different x-ray generating beams for the same tube.

7. An x-ray tube according to claim 4 wherein the two cathode emitters equipped with concentration devices, which are negatively polarizable, create for similar polarizations two beams of different thickness, creating two electron beams of different sizes landing on the anode.

8. An x-ray tube according to claim 4 wherein the cathodes are polarizable by a negative charge large enough to block electrons emitted by the emitters to permit intermittent operation of the tube.

9. An x-ray tube according to claim 1, wherein said anode is of the fixed type, and said divergence reduction diaphragm being mounted on the anode and having the same charge, and the curved diaphragm opening is centered on the revolution axis of the glass casing, so that the x-ray beam, emitted perpendicularly to the direction of the electron beam going from the cathode towards the impact surface of the anode, goes through the opening having the parallel opaque blades.

10. An x-ray tube according to claim 9, wherein the diaphragm is in the shape of a ring which completely surrounds the anode, thus allowing a good field distribution inside the glass casing of the x-ray tube.

* * * * *